US005230202A

United States Patent [19]

Propach et al.

[11] Patent Number: 5,230,202

[45] Date of Patent: Jul. 27, 1993

[54] PROCESS AND DEVICE FOR PULLING STOCKINGS OFF A STRETCHER

[75] Inventors: Hans-Walter Propach, Zell; Werner Müller, Heiningen, both of Fed. Rep. of Germany

[73] Assignee: August Krempel Sohne GmbH & Co., Fed. Rep. of Germany

[21] Appl. No.: 950,428

[22] Filed: Sep. 23, 1992

[30] Foreign Application Priority Data

Sep. 24, 1991 [DE] Fed. Rep. of Germany ..... 4131802

[51] Int. Cl.[5] ..... B65B 25/20; B65B 63/04

[52] U.S. Cl. ..... 53/429; 53/117; 223/37

[58] Field of Search ..... 53/429, 117, 116; 223/37, 38, 1

[56] References Cited

U.S. PATENT DOCUMENTS 3,742,676 7/1973 Lawing et al. ..... 53/117 X
3,750,916 8/1973 Stringer et al. ..... 53/117 X
3,768,226 10/1973 Glaze, Jr. ..... 53/117 X
4,720,090 1/1988 Ganno et al. ..... 53/117 X
4,922,685 5/1990 Hodges ..... 53/117 X
5,048,263 9/1991 Lau ..... 53/429

FOREIGN PATENT DOCUMENTS 2181465 9/1986 United Kingdom .

*Primary Examiner*—James F. Coan
*Attorney, Agent, or Firm*—Harness, Dickey & Pierce

[57] ABSTRACT

In a process for pulling stockings off a stretcher, the stockings are stretched on two essentially U-shaped frames next to one another. The stockings are pulled off the frames means of pull-off belts placed laterally against the narrow side of the frame. While the stockings are being pulled off the stretcher, folding of the stockings is already being initiated, ensuring correct position of the fold and ruling out later changes in shape. Preferable the folding apparatus has a package liner feeder, so that the stockings are folded around a package liner under tension. This completely rules out later shrinkage of the stockings.

15 Claims, 3 Drawing Sheets

PROCESS AND DEVICE FOR PULLING STOCKINGS OFF A STRETCHER

The invention concerns a process for pulling stockings off a stretcher, in which the stockings are stretched on two essentially U-shaped frames next to one another, and in which the stockings are pulled off the frames by a pull-off means.

The invention furthermore concerns a device for pulling stockings off a stretcher, with two essentially U-shaped frames that are arranged side by side and parallel to one another and on which the stockings can be stretched, and with a pull-off means for pulling the stockings off the frames.

Hereinafter the designation "stockings" will be used as a general term for stockings in the form of individual stockings, and for stockings in the form of tights.

When stockings are dyed, the fabric wrinkles and shrinks to some degree. To restore a smooth appearance to the stockings, they must therefore be stretched on a stretcher after the dyeing process, and subjected to a heat treatment. Conventionally, the stockings are also usually checked visually for defects while they are stretched on the stretcher.

After the heat treatment, the stockings are, in the conventional procedure, pulled off the stretcher and lastly conveyed to a packaging machine, in which they are packaged for sale.

At the last processing station of a conventional stretching machine, the stockings are pulled off the stretcher, which consists of two U-shaped frames arranged next to one another, and transferred by means of a conveyor belt or the like to a packaging machine downstream.

Since the stockings are still generally at a relatively high temperature when pulled off the frames, due to the heat treatment performed previously, the final shape of the stockings can still change after they are pulled off the stretcher, due to shrinkage processes or the like.

Because the stockings pulled off the stretcher are transferred by means of a conveyor belt or the like to the downstream packaging device, it is moreover also possible for the stockings to change position, so that in some circumstances they will not be placed into the packaging in the desired position.

GB-2,181,465 A discloses a device and a process of the aforesaid type in which the stockings are stretched on two essentially U-shaped frames next to one another, and are first subjected, in a testing device, to a visual inspection for defects. From the testing device, the stockings are automatically transferred to a stretching device in which the stockings, stretched on the frames, are heated to smooth and dry them. The frames are rotatably fixed at their lower end in such a way that they can be pivoted about the long axis from an arrangement in which they are aligned with one another into an arrangement in which they are parallel to one another. Once the heat treatment is complete, the frames are pivoted about their long axes with respect to one another, so that the two legs of a pair of tights lie parallel to one another. Then the tights are pulled off the two frames, for example by means of lateral rollers.

This device and this process also have the disadvantages mentioned earlier, meaning that as a result of the previously applied heat treatment, the final shape of the stockings can still change after they are pulled off the stretcher, because of shrinkage processes or the like. A change in the position of the stockings or tights after being pulled off the stretcher also cannot be ruled out.

The underlying object of the invention is therefore to create a process and a device for pulling stockings off a stretcher, with which the danger of changes in the position or shape of stockings after being pulled off the stretcher is reduced.

According to the invention, this object is achieved by the fact that in a process of the aforesaid type, transverse folding of the stockings is initiated while the stockings are being pulled off the stretcher.

According to the process in accordance with the invention, the stockings are therefore still held at one end between the frames and the pull-off means consisting of belts, rollers, or the like, while the folding process transverse to the lengthwise direction of the stocking legs is already being initiated in another region of the stockings. The stockings are thus still under tension at the beginning of the folding process, guaranteeing positionally correct folding. Subsequent shrinkage, changes in position, or wrinkling are excluded by placement between belts during the folding process.

In addition, the stockings are also cooled additionally during the folding process, thus further counteracting later shrinkage.

In an advantageous development of the process, the stockings are folded around a package liner.

The advantage of this feature is that the stockings are folded around the package liner while they are still being pulled off the stretcher, as a result of which their position in the later packaging is finally defined. Later changes in the position and shape of the stockings are thus completely ruled out.

In an additional development of the process, the position of the stockings along the length of the frames is detected in order to define the position of the folding edge and/or of the inserted package liner.

This feature ensures that folding occurs at the predefined location on the stockings, and that the stockings are folded around the package liner at the desired point.

With regard to the device, the object is achieved, according to the invention, by the fact that in a device of the aforesaid type, the pull-off means for pulling off the stockings is followed by a folding means for transverse folding of the stockings.

Since, according to the invention, the folding means for transverse folding of the stockings immediately follows the pull-off means, any change in the position of the stockings in the folding means is ruled out, since the stockings are still partly held in the pull-off means during the folding procedure. Transverse folding of the stockings is therefore already being initiated while the stockings are still held at their upper end between the frames and the pull-off means. Thus the stockings are still under tension while transverse folding occurs. This also largely eliminates subsequent shrinkage or wrinkling.

Since conveyor belts or the like leading to a downstream packaging machine are eliminated, the resulting configuration of the device is also considerably simplified.

In an advantageous embodiment, the pull-off means has two adjustable pull-off belts that can be brought laterally against the narrow side of the frame. With these, the stockings can easily be pulled off after the frames are folded together about their long axis.

In an advantageous embodiment of the invention, the folding means has a package liner feeder.

Since the stockings are thereby folded around a package liner, the stockings are immobilized in the correct position while still under tension, thus completely excluding later changes in the shape and position of the stockings, as well as shrinkage processes.

In a further embodiment of the invention, the pull-off belts are followed by two first belts which are followed by at least two further belts arranged at an angle to the aforesaid belts, with a folding slider being insertable laterally between the first belts and the two further belts.

This guarantees immediate folding while pulling-off is still in progress.

In a further embodiment of the invention, the package liner feeder to deliver package liners onto the top of the folding slider is associated with the folding slider.

The advantage of this feature is that when the stockings are folded up by means of the folding slider, a package liner can simultaneously be delivered, thus finally defining the stockings in terms of their position and shape.

In an additional development of the invention, a photoelectric barrier, by means of which the position of the stockings on the frames during the pulling-off process can be detected, is provided.

This makes it possible to fold the stockings precisely at a predetermined point, and if applicable, to deliver a package liner in the correct position.

It is understood that the features mentioned above and those yet to be explained below can be used not only in the respective combinations indicated, but also in other combinations or in isolation, without leaving the context of the present invention.

An exemplary embodiment of the invention is depicted in the drawings and will be explained further in the description below. In the drawings.

Figure 1:
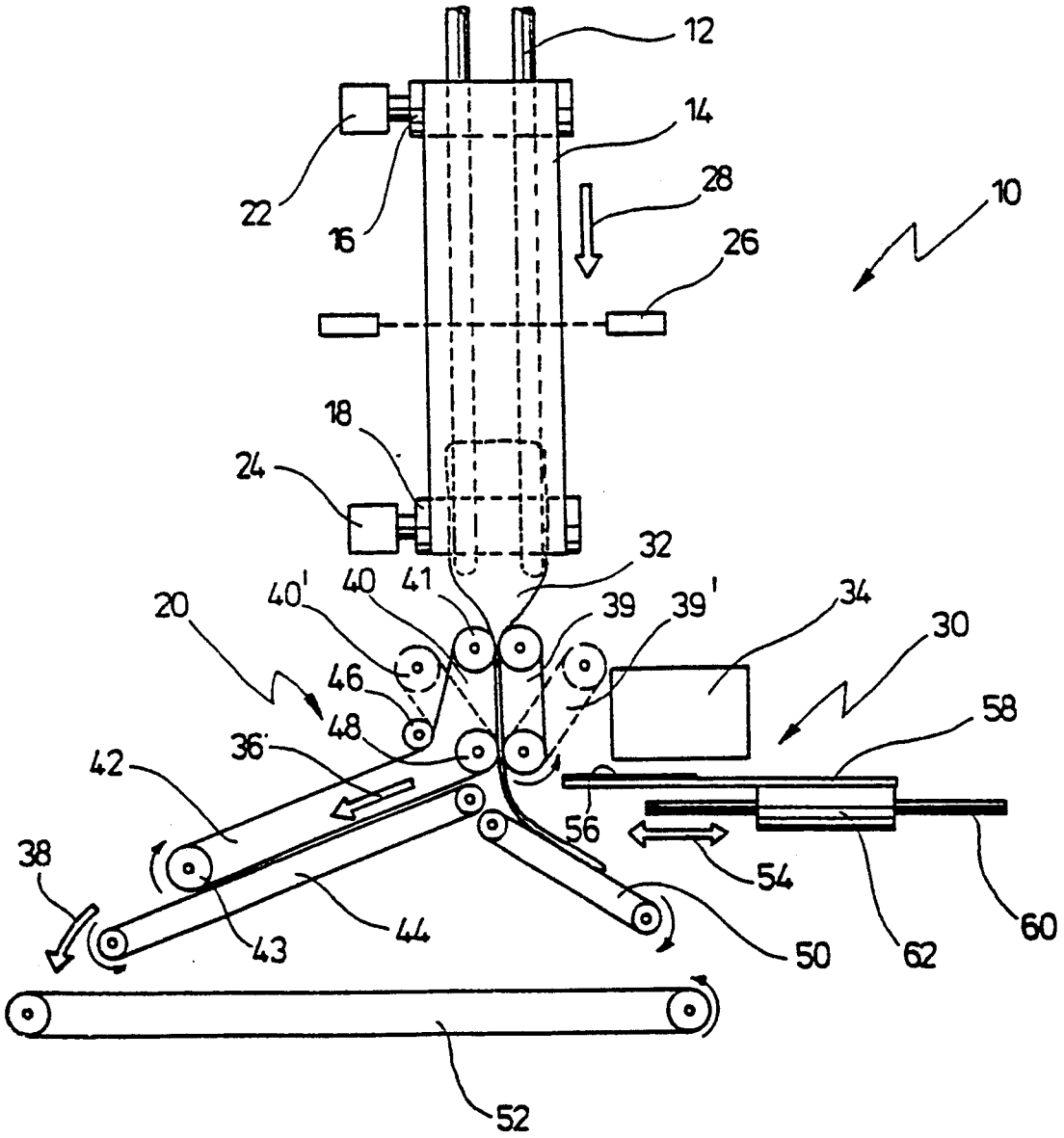
FIG. 1 shows a side view of a device according to the invention, in a schematic depiction.

In FIG. 1, a device according to the invention is labeled as a whole with the number 10. Two frames 12, parallel to one another and made of round bars bent into a U-shape, are provided. At their upper ends the frames 12 are rotatably fixed in a manner not depicted, so that they can be pivoted from an arrangement aligned with one another into an arrangement parallel with one another, according to FIGS. 1 to 3.

Stretched on the frames 12 is a pair of tights 32 that at previous stations of a shaping machine were stretched and subjected to a heat treatment.

To slip the tights 32 off the two frames 12, the latter are first pivoted parallel to one another (in a manner not described further), so that the stocking legs, stretched flat, are parallel to one another.

In this position two vertically arranged pull-off belts 14, each of which is guided over an upper roller 16 and a lower roller 18, are then pivoted laterally against the narrow sides of the frame 12, resulting in the position shown in FIG. 1. To pivot the pull-off belts 14, the upper roller 16 and the lower roller 18 are each fastened to a pivot apparatus 22 and 24, each of which makes possible a 90-degree pivoting movement, with the lower pivot apparatus 24 being combined with a drive.

Arranged approximately in the center between the upper rollers 16 and the lower rollers 18, transverse to the long axis of the frames 12, is a photoelectric barrier 26 that delivers a switching signal as soon as the upper waistband of a pair of tights 32 moves downward out of the light beam.

The pull-off belts 14 in contact with the frames 12 are each driven in opposite directions to one another, so that the tights 32 are gently pulled in the direction of the arrow 28 vertically downward off the frames 12.

Arranged below the pull-off belts 14 is a folding means, labeled as a whole with the number 20, for folding the tights transversely, which has a lateral package liner feeder that is labeled as a whole with the number 30.

Arranged in the center below the lower rollers 18 are two first belts 39, 40 for additional transport of the tights 32. While one belt 39 is guided only by an upper roller and a lower roller, and can be pivoted outward at its upper roller into a position indicated by the number 39', the other belt 40 is continuous with a subsequent second belt 42 which is oriented obliquely outward. The two belts 40 and 42 therefore have an upper roller 41, a shared center roller 48, and a lower roller 43. Arranged laterally next to the center roller 48 is an idler roller 46 offset outward, against which the continuous belt lies. The top part of this belt represents the first belt, which can be pivoted at its upper roller 41 between a vertical position indicated by the number 40, and an oblique position indicated by the number 40'.

If the two first belts are pivoted parallel to one another into their positions 39, 40 parallel to one another, the two belts touch one another, so that the lower part of the tights 32, pulled off the frames 12 by means of the pull-off belts 14 above, are moved vertically downward between these belts.

Below the second belt 42 that proceeds obliquely outward from the center roller 48, there is arranged, a short distance away, a belt 44 parallel to it, so that the tights can be transported obliquely outward between these two second belts 42, 44.

Arranged below the first belts 39, 40 is an additional belt 50 whose lower end is oriented obliquely outward, but in the opposite direction from the other belt 44.

Figure 2:
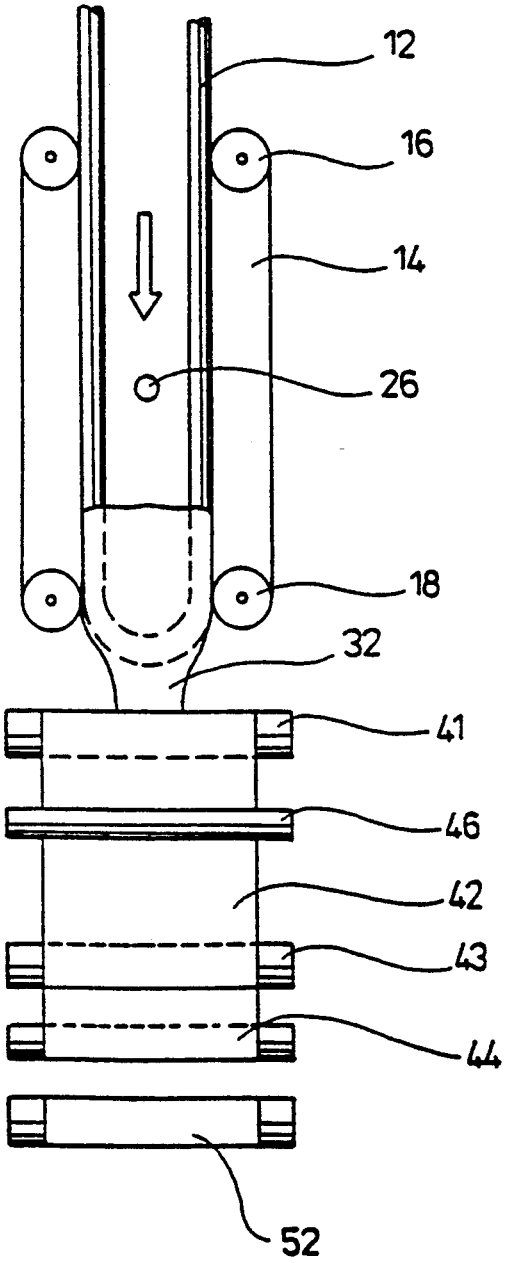
FIG. 2 shows a front view of the device according to FIG. 1, in a schematic depiction.

When, according to FIGS. 1 and 2, the tights 32 are gradually pulled downward off the frames 12 by the pull-off belts 14, the two first belts 39, 40 are pivoted parallel to one another as soon as the stocking legs project sufficiently far downward that they can be transported vertically downward between the first belts 39, 40. The tights are now moved vertically downward under tension between the first belts 39, 40 until the legs leave the lower end of the first belts 39, 40 and come into contact with the belt 50 placed vertically outward, as a result of which the ends of the tights 32 are moved outward.

Once the tights 32 have been pulled sufficiently far downward off the frames 12, a folding slider 58 that can travel laterally and horizontally is moved towards the gap between the upper ends of the second belts 42, 44 that run parallel to one another. As a result, the portion of the tights 32 projecting downward, which is in contact with the belt 50 placed obliquely outward, is moved along with the front edge of the slider between the two second parallel belts 42, 44, and lastly is moved obliquely downward in the direction of arrow 36 between these two belts, in a folded state. Once the tights 32 have been completely pulled off the frames 12, they are therefore once again moved obliquely outward between the two second belts 42 and 44, having been folded transversely.

Below the lower end of the lower second belt 44, which projects slightly outward with respect to the upper second belt 42 parallel to it, is provided a horizontal conveyor belt 52 for further transport of the tights 32. After leaving the second lower belt 44 in the direction of arrow 38, the tights 32 therefore fall onto the conveyor belt 52, on which they are moved to additional processing stations, such as for example a packaging apparatus.

Alternatively, the two second belts 42, 44 can also be followed by further belts which produce a second and possibly additional folds.

Arranged above the folding slider 58, which can be moved periodically on round bars 60, by means of a drive 62, horizontally in the direction of double arrow 54, is a package liner magazine 34, from which package liners 56 can be fed onto the top of the slider 58 so that they lie flat on the slider 58 in a predefined position.

When the slider 58, with a package liner 56 (as depicted in FIG. 1), is advanced against the lower portion of the tights 32 lying on the belt 50 placed obliquely outward, a piece of packaging cardboard 56 is fed in concurrently with transverse folding, so that as they are transported farther between the two second belts 42, 44, the tights 32 remain securely folded around it.

Figure 3:
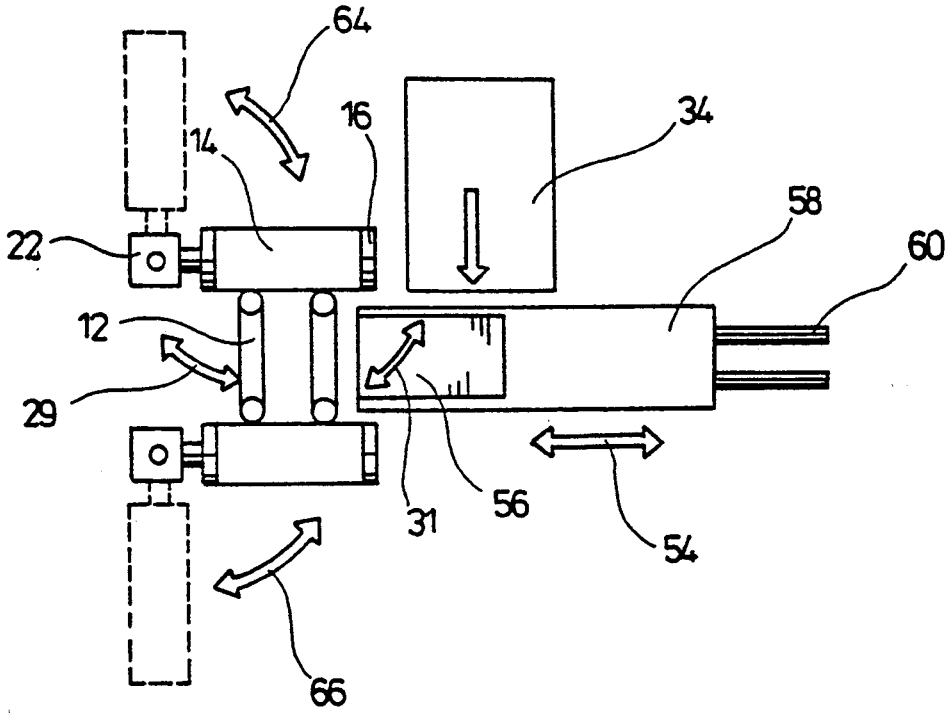
FIG. 3 shows a top view of the device according to FIGS. 1 and 2, in a schematic depiction.

It is evident from the schematic depiction according to FIG. 3 that before the pulling-off process begins, the frames 12 can be pivoted in the direction of arrows 29, 31 from an arrangement aligned with one another into an arrangement parallel to one another, as depicted in FIG. 3. It is also evident from FIG. 3 that the two pull-off belts 14 can be pivoted laterally in the direction of arrows 64, 66 against the narrow sides of the frames 12, which were previously pivoted parallel to one another.

What is claimed is:

1. A device for pulling stockings off a stretcher, comprising:

two essentially U-shaped frames that are arranged side by side and parallel to one another and adapted to receive said stockings after stretching thereof;

pull-off means for pulling said stockings off said frames; and folding means arranged after said pull-off means for transversely folding said stockings while being pulled off said frames.

2. Device according to claim 1, wherein said pull-off means includes two adjustable pull-off belts that can be brought laterally against a narrow side of each of said frames.

3. Device according to claim 1, wherein said folding means includes a package liner feeder.

4. Device according to claim 1, which further comprises two first belts which are arranged after said pull-off belts and which are followed by at least two further belts arranged at an angle with respect to said two first belts, and which further comprises a folding slider which is insertable laterally between said two first belts and said two further belts.

5. Device according to claim 4, which further comprises a package liner magazine associated with said folding slider and adapted to feed package liners onto the top of said folding slider.

6. Device according to claim 1, which further comprises a photoelectric barrier adapted to detect the position of the stockings on said frames during pulling-off.

7. Process for pulling stockings off a stretcher, in which the stockings are stretched on two essentially U-shaped frames next to one another, and in which said stockings are pulled off said frames by a pull-off means, wherein transverse folding of said stockings is initiated while said stockings are being pulled off said stretcher.

8. Process according to claim 7, wherein said stockings are folded around a package liner.

9. Process according to claim 7, wherein the position of said stockings along a longitudinal direction of said frames is detected in order to define the position of a folding edge.

10. A device for pulling stockings off a stretcher, comprising:

first and second frame members defining first and second parallel longitudinal centerlines, respectively, with each of said frame members having two essentially straight side edges arranged parallel to one another and on opposite sides of said respective centerline, said frames being adapted to receive said stockings;

pull-off means engageable with said stockings while on said frame members for pulling said stockings off said frame members;

folding means arranged for receiving said stockings from said pull-off means and transversely folding said stockings while said stockings are still engaged with said pull-off means.

11. Device according to claim 10, wherein said pull-of means includes two adjustable pull-off belts that can be brought laterally against a narrow side of each of said frames.

12. Device according to claim 10, wherein said folding means includes a package liner feeder.

13. Device according to claim 10, which further comprises two first belts which are arranged after said pull-off belts and which are followed by at least two further belts arranged at an angle with respect to said two first belts, and which further comprises a folding slider which is insertable laterally between said two first belts and said two further belts.

14. Device according to claim 13, which further comprises a package liner magazine associated with said folding slider and adapted to feed package liners onto the top of said folding slider.

15. Device according to claim 10, which further comprises a photoelectric barrier adapted to detect the position of the stockings on said frames during pulling-off.

* * * * *